US005694738A

United States Patent [19]

Shigeta

[11] Patent Number: 5,694,738

[45] Date of Patent: Dec. 9, 1997

[54] BODY FLAP FOLDING APPARATUS IN PACKAGING MACHINE

[75] Inventor: Toshio Shigeta, Chiba-ken, Japan

[73] Assignee: Tokyo Automatic Machinery Works, Ltd., Tokyo, Japan

[21] Appl. No.: 683,969

[22] Filed: Jul. 22, 1996

[51] Int. Cl.[6] ..... B65B 11/28; B65B 19/22

[52] U.S. Cl. ..... 53/234; 53/228; 53/375.9

[58] Field of Search ..... 53/234, 228, 466, 53/375.9, 229, 232, 251, 253, 225

[56] References Cited

U.S. PATENT DOCUMENTS

| | | | |
|---|---|---|---|
| 3,035,379 | 5/1962 | Cloots | 53/466 |
| 3,810,314 | 5/1974 | Anderson | 53/378 |
| 4,711,065 | 12/1987 | Focke et al. | 53/234 X |
| 4,983,154 | 1/1991 | Nagahashi et al. | 493/315 |
| 5,154,035 | 10/1992 | Cavazza | 53/77 |
| 5,177,933 | 1/1993 | Boriani et al. | 53/228 X |
| 5,269,117 | 12/1993 | Boriani et al. | 53/234 |
| 5,442,894 | 8/1995 | Ogata et al. | 53/234 |

FOREIGN PATENT DOCUMENTS

| | | |
|---|---|---|
| 0137334 | 4/1985 | European Pat. Off. . |
| 0166078 | 1/1986 | European Pat. Off. . |

OTHER PUBLICATIONS

A European Search Report and Annex. (Dec. 2, 1996).

*Primary Examiner*—James F. Coan

*Attorney, Agent, or Firm*—Greenblum & Bernstein P.L.C.

[57] ABSTRACT

The present invention relates to a body flap folding apparatus in a packaging machine. Comb-shaped folding pieces are moved pivotally along arcuate tracks from edge portions of a folding surface of box-like contents. As a result, front ends of the folding pieces strike against body flaps at the edge portions, whereby the base portions of the body flaps are bent along the edge portions. Thereafter, resilient members are deformed in the direction opposite to their biasing direction by virtue of a reaction force from the folding surface, so that the folding pieces fold the body flaps inside along the folding surface in a strained state of the flaps. Further, even if with return movement of the folding piece for the inner body flap the inner body flap once folded tries to return in the direction opposite to the folding direction under the action of friction created between the folding piece and the inner body flap, the base end thereof strikes against a comb-shaped front end portion of a second holding face to prevent return of the inner body flap.

19 Claims, 4 Drawing Sheets

BODY FLAP FOLDING APPARATUS IN PACKAGING MACHINE

TECHNICAL FIELD OF THE INVENTION

The present invention relates to a body flap folding apparatus in a packaging machine wherein box-like contents such as cartoned contents of accumulated packages, e.g. cigarette packages, are packaged with a heat- bondable packaging material such as, for example, cellophane or polypropylene film, or box-like contents of mere accumulated small-box packages of cigarettes are packaged with a heat- bondable packaging material such as, for example, hot melt sand paper or kraft paper. More particularly, the invention is concerned with a body flap folding apparatus in a packaging machine wherein box-like contents are struck against a packaging material, allowing the packaging material to be wound in U shape around the box-like contents, then the box-like contents and the packaging material thus wound thereon are loaded successively into each of plural pockets provided radially on the outer periphery of a turret, and body flaps of the packaging material are folded inside in order and heat-bonded together while the box-like contents and the packaging material are conveyed with rotation of the turret.

BACKGROUND ART

According to a conventional body flap folding apparatus of this type, as disclosed, for example, in U.S. Pat. No. 3,810,314, box-like contents with a packaging material wound in U shape around the body thereof are loaded into a pocket of a turret which is standing by in a rest state, then after this pocket has moved upward rotatively by a predetermined angle with an intermittent rotation of the turret and stopped, first an inner body flap folding piece begins to move pivotally and strikes against an inner body flap of the packaging material located in a lower position on the side opposite to the rotating direction of the turret, whereby the inner body flap is folded inside along a folding surface of the box-like contents, then nearly simultaneously with a return movement of the inner body flap folding piece an outer body flap folding piece begins to move pivotally and strikes against an outer flap of the packaging material located in an upper position in the turret rotating direction, whereby the outer body flap is folded inside and onto the already folded inner body flap along the folding surface of the box-like contents, and during the next turret rotation or after the stop of turret rotation a heater is brought into pressure contact with the superimposed portion of the body flaps to heat-bond the flaps, thereby completing the body flap folding.

According to another body flap folding apparatus, for the purpose of reducing the number of components, a heater is attached to an outer body flap folding piece, whereby at the same time when an outer body flap is folded inside along a folding surface of box-like contents and is superimposed on an already folded inner body flap, the superimposed portion heat-bonded to complete body flap folding.

According to a further conventional body flap folding apparatus, as disclosed, for example, in U.S. Pat. No. 3,810,314, box-like contents with a packaging material wound in U shape therearound are loaded into a pocket of a turret which is standing by in a rest state, then after the said pocket has turned upward by a predetermined angle with an intermittent rotation of the turret and stopped, first an inner body flap folding piece begins to move pivotally and strikes against an inner body flap of the packaging material located in a lower position on the side opposite to the rotating direction of the turret to fold the inner body flap inside along a folding surface of the box-like contents, then almost simultaneously with a return movement of the inner body flap folding piece an outer body flap folding piece starts to move pivotally and strikes against an outer body flap of the packaging material located in an upper position in the turret rotating direction to fold the outer body flap inside along the folding surface of the box-like contents, allowing it to be superimposed on the already folded inner body flap, then during the next turret rotation or after the stop of rotation a heater is brought into pressure contact with the superimposed portion of the body flaps to heat-bond the flaps, and in this way the body flap folding is completed.

However, in such conventional body flap folding apparatus in packaging machines, particularly in the former case, swing tracks of the inner and outer body flap folding pieces describe circular arcs such that the folding pieces pass through positions spaced away from corner portions of the folding surface of the box-like contents and strike against the body flaps, and at a time point near the end of the swing motions they come into pressure contact with the folding surface of the box-like contents, therefore the outer and inner body flaps which have a large length in the folding direction cannot be folded tightly along the folding surface of the box-like contents, resulting in that the body flaps are heat-bonded in a loose state, thus leading to deterioration in the appearance of a finished product obtained and hence deterioration of its commercial value.

Moreover, when the inner body flap folding piece performs a return movement after it has folded the inner body flap, the inner body flap once folded is returned in the direction opposite to the folding direction due to friction between the folding piece and the inner body flap. Consequently, the inner body flap is heat-bonded in a loose state, thus also leading to deteriorated appearance of the resulting finished product and marked deterioration of its commercial value.

Further, in the case where a heater is attached to the outer body flap folding piece and when the outer body flap folding operation is stopped halfway due to inching for example, the heater is also in abutment with the superimposed portion of the inner and outer body flaps, so the superimposed portion gets burnt or deformed thermally, thus giving rise to the problem that the appearance of a finished product obtained is deteriorated and a marked deterioration of its commercial value results.

In the latter case, after rotation of the turret, the inner body flap located on the side opposite to the turret rotating direction is folded and thereafter the outer body flap located in the rotating direction is folded inside, so there is a fear that the outer body flap may fall down in the direction opposite to the rotating direction with rotation of the turret prior to folding of the inner body flap. Once this trouble occurs, it becomes impossible to fold both body flaps surely in good order, thus causing such problems as poor heat-bonding, deteriorated appearance of a finished product obtained and consequent marked deterioration of its commercial value.

DISCLOSURE OF THE INVENTION

It is the first object of the present invention to fold outer and inner body flaps having a larger length in the folding direction in a strained state from corner portions of a folding surface of the box-like contents and thereby completely prevent loosening of the inner body flap caused by a return movement of an inner body flap folding piece.

It is the second object of the present invention to prevent direct contact of a heater with a body flap even in the event the outer body flap folding operation stops halfway.

It is the third object of the present invention to prevent an outer body flap from falling down before folding of an inner body flap in order for both flaps to be folded surely in good order.

In order to achieve the above first object the present invention comprising a front end portion of a first holding face of each of plural pockets which front end portion is opposed to an outer body flap of a packaging material projecting from box-like contents, and a front end portion of a second holding face of the pocket which front end portion is opposed to an inner body flap of the packaging material projecting from the box-like contents, are each formed in the shape of a comb having convexes and concaves which are continuous alternately in the right and left direction orthogonal to the projecting direction of those body flaps;

an outer body flap folding piece and an inner body flap folding piece are each formed in the shape of a comb so that respective front ends come into fitting engagement with the comb-shaped front end portions of the first and second holding faces, and the folding pieces are supported pivotably in the direction of fitting engagement with the comb-shaped front end portions of the first and second holding faces;

the said front ends are mounted reciprocatably in a direction to approach or leave a folding surface of the box-like contents relative to respective pivotable arms; and a resilient member is disposed between each of the said front ends and each of the said pivotable arms in such a manner that a front end thereof is normally urged to the folding surface of the box-like contents, and by controlling the amount of a resilient movement of the front end the front end is moved along an arcuate track which gradually gets into the box-like contents through the folding surface of the box-like contents from a corner portion positioned on the to-be-folded body flap side of the said folding surface with a pivotal motion of the pivotable arm.

It is preferable that a stopper connected to each pivotable arm be struck against the front end of each of the out and inner body flap folding pieces to control a swing angle corresponding to the amount of a resilient movement of the said front end and that the said swing angle be set in such a manner that a swing radius from the fulcrum of the pivotable arm becomes equal to the distance between the said fulcrum and the corner portion positioned on the to-be-folded body flap side of the folding face of the box-like contents.

According to the above construction, by allowing each comb-shaped folding piece to move pivotally along an arcuate track from a corner portion of the folding surface of the box-like contents, the front end of the folding piece strikes against the body flap at the corner portion and bends the base portion of the body flap along the said corner portion, then with deformation of the resilient member in the direction opposite to the biasing direction by virtue of a reaction force from the folding surface the folding piece folds the body flap in a strained state along the folding surface, further, with a return movement of the inner body flap folding piece, even if the inner body flap tries to return in the direction opposite to the folding direction due to friction generated between the folding piece and the inner body flap once folded, the base end of the inner body flap strikes against the comb-shaped front end portion of the second holding surface to prevent the return thereof.

Thus, the outer and inner body flaps having a large length in the folding direction are folded in a strained state each from a corner portion of the folding surface of the box-like contents, whereby it is made possible to completely prevent loosening of the inner body flap caused by a return movement of the inner body flap folding piece. Therefore, in comparison with the conventional apparatus wherein the swing track of each of inner and outer body flap folding pieces describes a circular arc such that the folding piece passes a position spaced away from a corner portion of the folding surface of box-like contents, then strikes against the body flap, and at a time point near the end of its pivotal motion, comes into pressure contact with the said folding surface of box-like contents, and wherein at the time of return movement of the inner body flap folding piece the inner body flap once folded is returned in the direction opposite to the folding direction due to friction between the folding piece and the inner body flap, the above construction according to the present invention permits heat-bonding of the body flaps to be done in a tight manner, so that the appearance of a finished product obtained is improved and the commercial value thereof is also improved remarkably.

In the present invention, in order to achieve the above second object, it is preferable that a tack heater for pressure contact with the superimposed portion of folded inner and outer body flaps be provided in a rear position in the swing direction of the outer body flap folding piece.

According to the above constructions, subsequent to folding of the outer body flap, the tack heater comes into pressure contact with the superimposed portion of the inner and outer body flaps to effect tacking.

Thus, even in the event the outer body flap folding operation stops halfway, it is possible to prevent direct contact of the heater with the body flaps. Therefore, in comparison with the conventional body flap folding apparatus wherein a heater is in contact with the superimposed portion of inner and outer body flaps when the outer body flap folding operation has stopped halfway due to inching for example, the superimposed portion according to the present invention does not get burnt or undergo a thermal deformation and the appearance of a finished product obtained is improved, thus leading to remarkable improvement of its commercial value.

According to the present invention, in order to achieve the foregoing third object, the front end portion of the first holding face of each of the plural pockets positioned on the turret rotating direction, which front end portion is opposed to the outer body flap of the packaging material projecting from the box-like contents, is provided with a suction and holding means for sucking and holding the outer body flap in a section from the loading position of both box-like contents and packaging material to the outer body flap folding position.

The said suction and holding means preferably comprises:

suction holes formed in the first holding face opposingly to the outer body flap;

a suction source communicating with the suction holes;

passages for communication between the suction holes and the suction source; and a suction control portion for providing communication of the said passages only in the section from the pocket stopped in the loading position and the pocket stopped in the folding position.

According to the above constructions, the outer body flap is held by suction at the front end portion of the first holding face from the section from the loading position of both box-like contents and packaging material up to the outer body flap folding position, by the suction and holding means. Consequently, even when the pocket with box-like contents and packaging material loaded therein is rotated from the said loading position, the outer body flap is maintained in its stand-up position without falling down in the direction opposite to the rotational direction, which stand-up state is maintained from the time when the folding of the inner body flap is over until when the outer body flap is folded.

Thus, in order to ensure folding of the inner and outer body flaps in good order, it is possible to prevent the outer body flap from falling down before folding of the inner body flap. Accordingly, as compared with the conventional body flap folding apparatus involving the trouble that with rotation of the turret the outer body flap falls down in the direction opposite to the turret rotating direction before folding of the inner body flap, the aforesaid point according to the present invention prevents unsatisfactory heat bonding and permits improvement in the appearance of a finished product obtained and remarkable improvement of its commercial value.

EMBODIMENT

An embodiment of the present invention will be described hereinunder with reference to the accompanying drawings.

Figure 4:
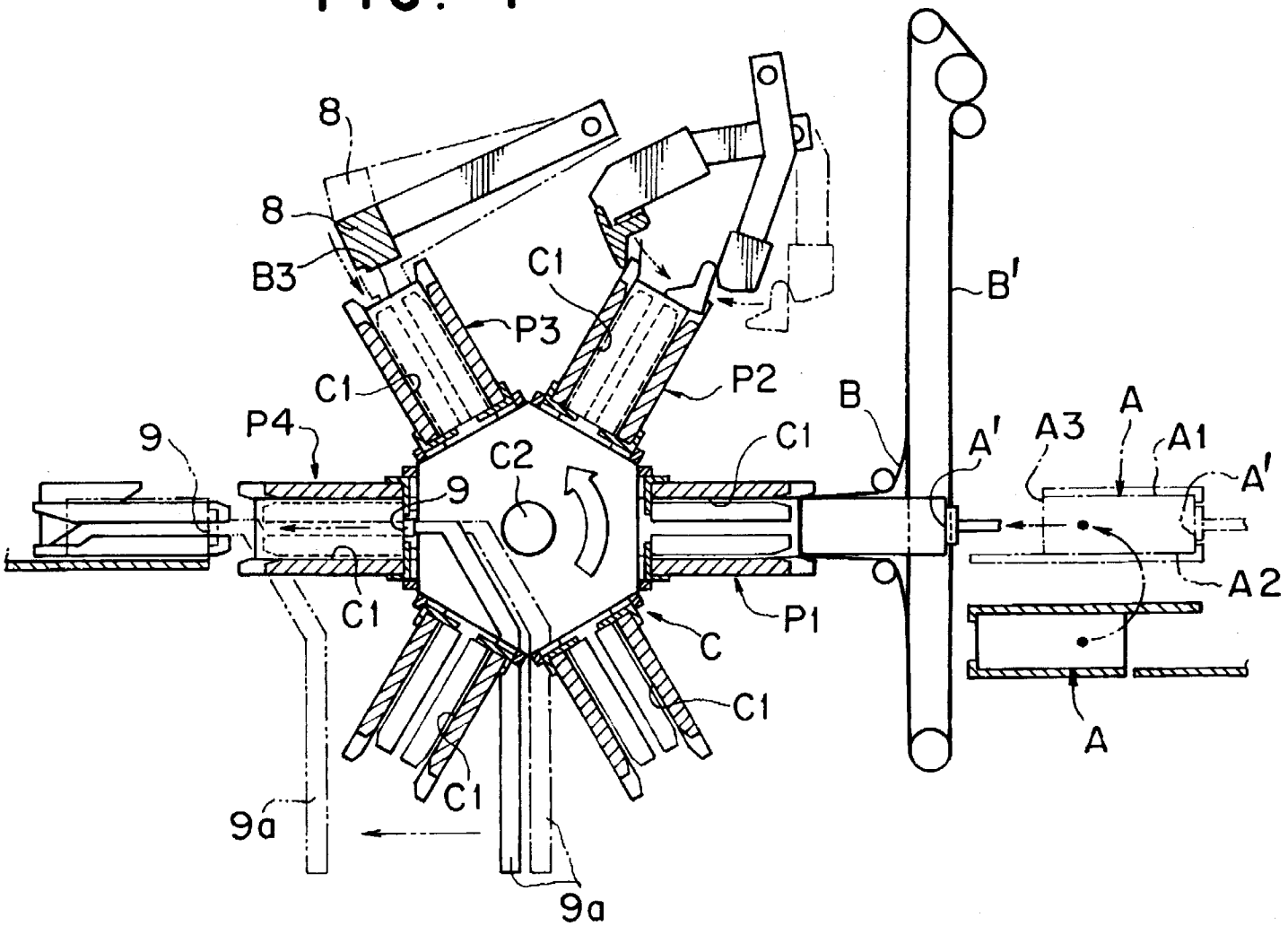
FIG. 4 is a front view in longitudinal section on a reduced scale of the entire apparatus in which the state halfway in the loading operation is indicated with solid lines.

According to this embodiment, as illustrated in FIG. 4, encased box-like contents A loaded from a cartoning machine in the preceding step are inverted and raised by means of an inverting mechanism so that the body portion of the carton becomes opposed to a packaging material such as cellophane film or polypropylene film loaded by a loading mechanism such as a suction belt for example. Then, the box-like contents B thus inverted and raised are pushed by means of a pusher A' which is adapted to reciprocate intermittently in the horizontal direction with a cam or the like, and is thereby struck against the packaging material B which is held nearly vertically, whereby the box-like contents A are loaded into a pocket C1 which is at rest in a loading position P1 on a turret C while the packaging material B is wound in U shape around the body of the carbon.

Figure 2:
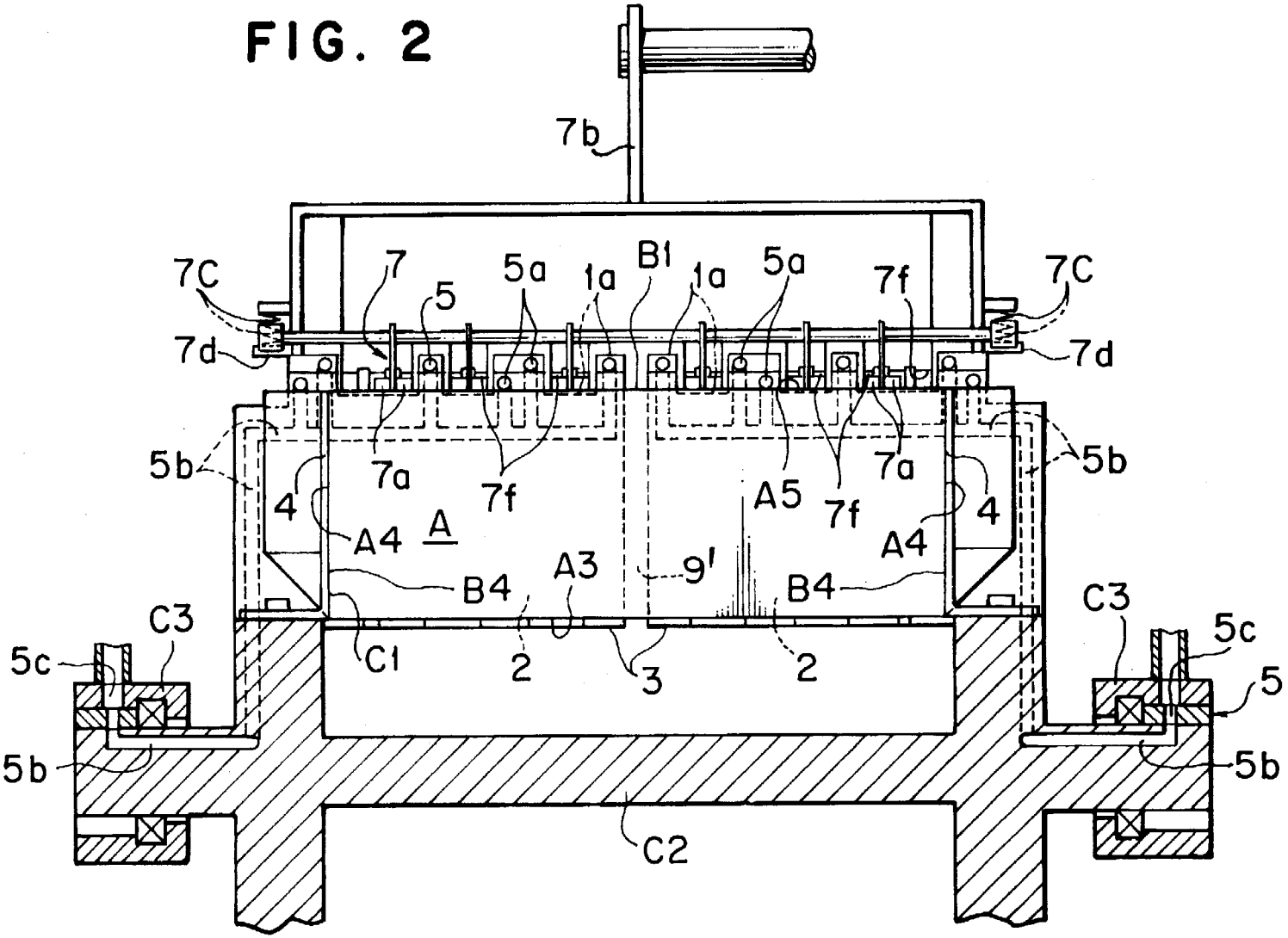
FIG. 2 a partial side view in longitudinal section on a reduced scale taken along line (II)—(II) in FIG. 1, showing a folded state.

The turret C has a rotating shaft C2, and plural (six in this embodiment) pockets C1 . . . are mounted radially on the outer periphery of the front end of the rotating shaft C2. As shown in FIG. 2, the rotating shaft C2 is journaled in an unrotatable support holder C3 and is connected to the same drive source of the pusher A' or to another drive source adapted to operate intermittently and synchronously with that drive source, whereby the pockets C1 . . . are turned 60° each time in an intermittent manner nearly simultaneously with a return movement of a folding piece 7 for an outer body flap B1 which will be described later, allowing the pocket C1 located in the loading position P1 to move upward toward a folding position P2 of inner and outer body flaps B2, B1 located 60° downstream of the loading position P1, allowing the pocket C1 located in the folding position P2 to move to a body flap bonding position P3 located 60° downstream of the folding position P2, and allowing the pocket C1 located in the body flap bonding position P3 to move to a discharge position P4 located 60° downstream of the position P3, as shown in FIG. 4. By the time when the succeeding box-like contents A strike against the packaging material by the operation of the pusher A', the rotation of the pockets C1 . . . is over and the pockets are stopped successively in the respective downstream-side folding position P2, body flap bonding position P3 and discharge position P4.

Figure 1:
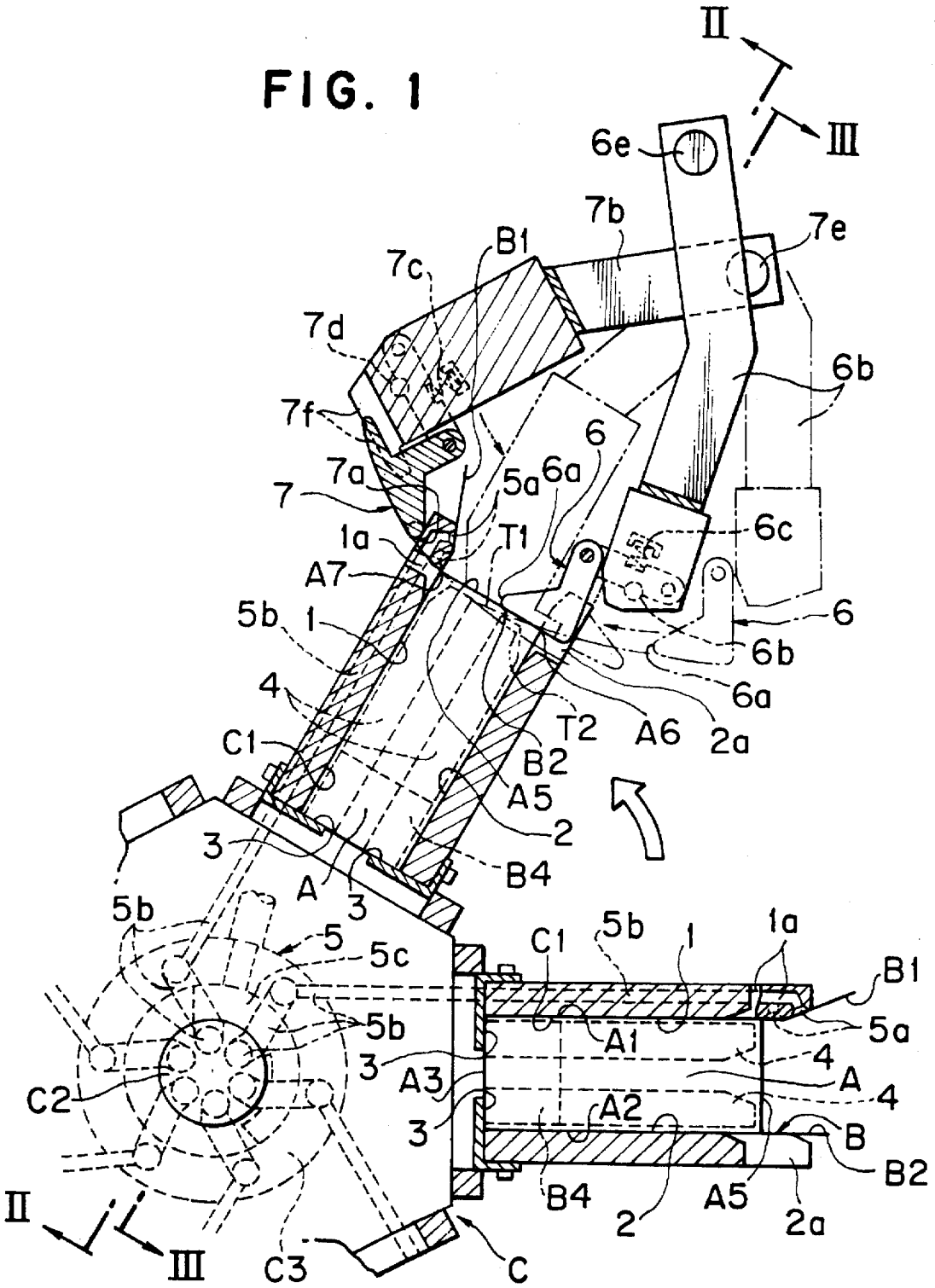
FIG. 1 is a partial front view in longitudinal section of a body flap folding apparatus in a packaging machine according to an embodiment of the present invention, showing a folding state in a partially cutaway form.
Figure 3:
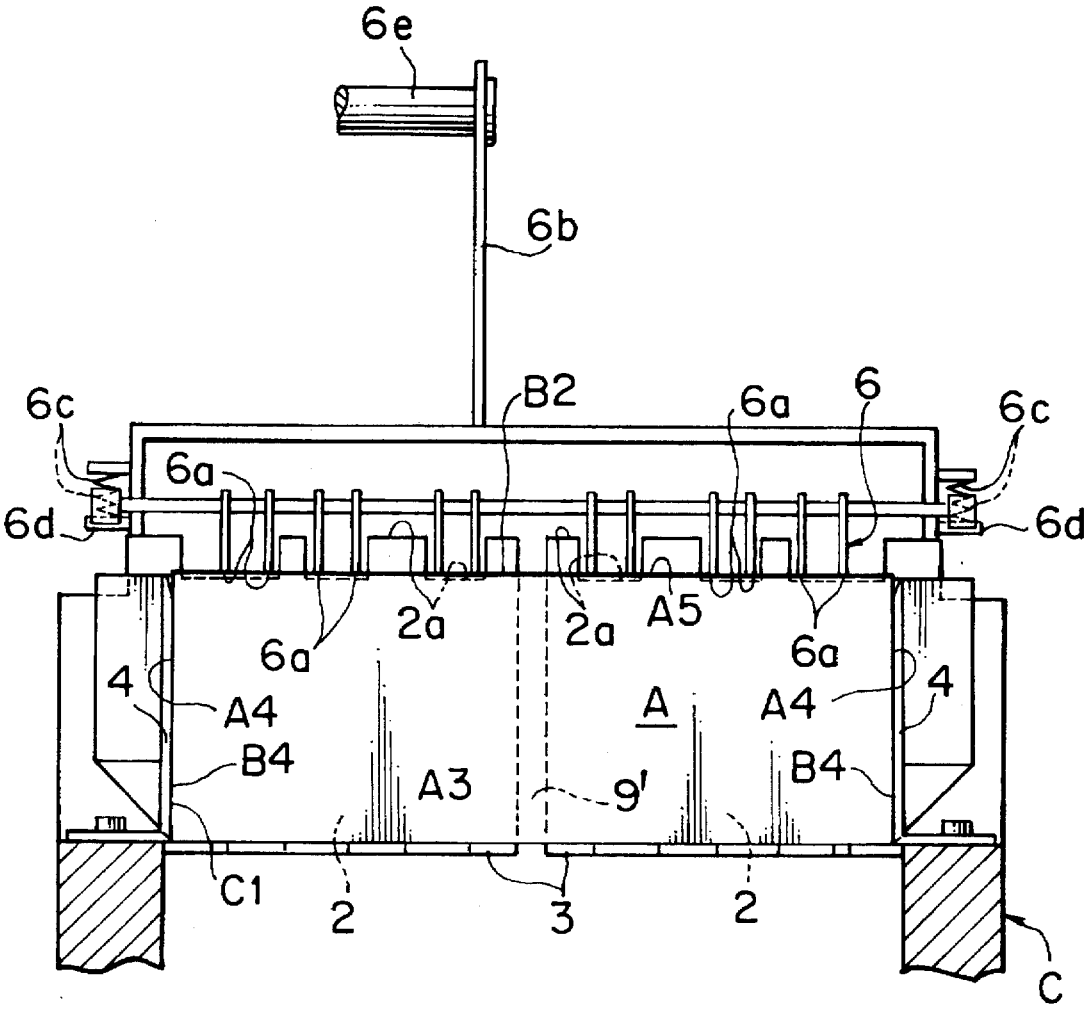
FIG. 3 is a partial side view in longitudinal section on a reduced scale taken along line (III)—(III) in FIG. 1.

As shown in FIGS. 1 to 3, each pocket C1 comprises a first holding face 1 and a second holding face 2 opposed respectively to upper and lower faces A1, A2 of the box-like contents A loaded into the pocket in the loading position P1, a striking face 3 opposed to a front-end face A3 of the box-like contents and third holding faces 4, 4. A front end portion 1*a* of the first holding face 1 positioned on the rotating direction side of the turret C which front end portion 1*a* is opposed to the outer body flap B1 of the packaging material B projecting from the box-like contents A, and a front end portion 2*a* positioned on the side opposite to the turret rotating direction and opposed to the inner body flap B2 of the packaging material B projecting from the box-like contents A, are formed in the shape of a comb having convexes and concaves which are continuous alternately in the right and left direction orthogonal to the projecting direction of the outer and inner body flaps B1, B2.

In this embodiment, the positions of the first and second holding faces 1, 2, third holding faces 4, 4 and front-end face A3 are made adjustable according to a change in size of the box-like contents A so as to permit adjustment of the spacing between the first and second holding faces 1, 2, the spacing between the third holding faces 4, 4 and the distance from the front end portions 1*a*, 2*a* to the front-end face A3.

The comb-shaped front end portion 1*a* of the first holding face 1 is provided with a suction and holding means 5 for sucking and holding the outer body flap B1 in the section from the loading position P1 of the box-like contents A and packaging material B to the folding position P2 of the outer body flap B1.

According to the structure of the suction and holding means 5, a plurality of suction holes 5*a* . . . are formed in the comb-shaped front end portion 1*a* of the first holding face 1 in an opposed relation to the outer body flap B1, the suction holes 5*a* . . . being brought into communication with a suction source (not shown), say, a vacuum pump, and halfway in passages 5*b* . . . which provide communication between the suction holes 5*a* and the suction source there is provided a suction control portion 5*c* which permits communication of the passages 5*b* . . . only in the section from the pocket C1 stopped in the loading position P1 up to the pocket C1 stopped in the folding position P2.

As indicated with broken lines in FIG. 1 and also shown in FIG. 2, the passages 5*b* . . . are connected to the rotating shaft C2 of the turret C in such a manner that their terminal ends are arranged at equal intervals in the circumferential direction along the outer peripheral surface of the rotating shaft C2 and toward the support holder C3. The inner peripheral surface of the support holder C3 opposed to the terminal ends of the passages 5*b* . . . is partially recessed to form the suction control portion 5*c* normally in communication with the suction source in such a manner that the suction control portion is in conformity with the terminal end of only the passage 5b of the pocket C1 positioned in the section from the loading position P1 to the folding position P2.

Around the pocket C1 stopped in the folding position P2 are disposed a folding piece 6 for the inner body flap B2 and a folding piece 7 for the outer body flap B1.

As shown in FIG. 3, a front end 6a of the inner body flap folding piece 6 is formed in the shape of a comb for fitting engagement with a comb-shaped front end portion 2a of the second holding face 2 and is supported pivotably through a pivotable arm 6b in the direction of fitting engagement with the comb-shaped front end portion 2a. The front end 6a is mounted to the pivotable arm 6b reciprocatabley (pivotably in this embodiment) in an approaching or leaving direction with respect to a folding surface A5 of the box-like contents A. Further, between the front end 6a and the pivotable arm 6b is disposed a resilient member 6c, e.g. spring, to urge the front end 6a continually toward the folding surface A5 of the box-like contents A, and a stopper 6d connected to the pivotable arm 6b is struck against the front end 6a to restrict a swing angle corresponding to the amount of a resilient movement of the front end 6a. The said swing angle is set so that a swing radius from a fulcrum 6e of the pivotable arm 6b becomes equal to the distance between the fulcrum 6e and an edge portion A6 positioned on the inner body flap B2 side of the folding surface A5 which corresponds to an end surface of the box-like contents A.

Therefore, with swing motion of the pivotable arm 6b, the front end 6a of the folding piece 6 moves pivotally along an arcuate track T1 which conducts the front end 6a to gradually get in the interior of the box-like contents A through the holding surface A5 from the edge portion A6 positioned on the inner body flap B2 side of the folding surface A5 of the box-like contents A. In this case, since the front end 6a slides along and in contact with the folding surface A5, it undergoes a reaction force from the folding surface A5 and hence swings while causing the resilient member 6c to be deformed in the direction opposite to the biasing direction against the biasing force of the resilient member.

Further, the folding piece 6 for the inner body flap B2 is connected to the same drive source as that of the pusher A' and turret C, whereby its operation is controlled intermittently through a cam or the like. More specifically, during rotation of the turret C or just after stop of the rotation, the folding piece 6 is started to swing in the folding direction of the inner body flap B2 from its stand-by position not interfering with the movement of the pockets C1 . . . , then after the stop of rotation of the turret C the front end 6a comes into engagement with the comb-shaped front end portion 2a of the second holding face 2, and when the front end 6a has reached a substantially central position of the folding surface A5 of the box-like contents A, it is moved back to the stand-by position.

As shown in FIG. 2, a front end 7a of the folding piece 7 for the outer body flap B1 is formed in the shape of a comb for fitting engagement with the comb-shaped front end portions 1a and 2a of the first and second holding faces 1, 2 and is supported pivotably in the direction of the said fitting engagement through a pivotable arm 7b. To the pivotable arm 7b is connected the front end 7a so as to be reciprocatable (pivotable in this embodiment) in an approaching or leaving direction with respect to the folding surface A5 of the box-like contents A. Between the front end 7a and the pivotable arm 7b is disposed a resilient member 7c, e.g. spring, to urge the front end 7a continually toward the folding surface A5 of the box-like contents A. A stopper 7d connected to the pivotable arm 7b is struck against the front end 7a to control a swing angle corresponding to the amount of a resilient movement of the front end 7a, which swing angle is set so that a swing radius from a fulcrum 7e of the pivotable arm 7b is equal to the distance between the fulcrum 7e and an edge portion A7 positioned on the outer body flap B1 side of the folding surface A5 of the box-like contents A.

Therefore, with swing motion of the pivotable arm 7b the front end 7a moves pivotally along an arcuate track T2 which conducts the front end 7a to get in the interior of the box-like contents A gradually through the folding surface A5 of the box-like contents from the edge portion A7 positioned on the outer body flap B1 side of the folding surface A5. Then, the front end 7a slides along and in contact with the folding surface A5 and thereby undergoes a reaction force from the folding surface A5, so that the front end 7a moves pivotally while causing the resilient member 7c to be deformed in the direction opposite to the biasing direction against the biasing force of the resilient member.

A comb-shaped tack heater 7f for fitting engagement with the comb-shaped front end portions 1a and 2a and for pressure contact with a superimposed portion B3 of the folded inner and outer body flaps B2, B1 is attached to the folding piece 7 in a rear position in the swing direction.

The folding piece 7 for the outer body flap B1 is connected to the same drive source as that of the pusher A', turret C and folding piece 6 of the inner body flap B2, and the operation thereof is controlled intermittently as follows by means of a cam for example. Just after the stop of rotation of the turret C the folding piece 7 is started to swing in the folding direction of the outer body flap B1 in interlock with the return movement of the folding piece 6 of the inner body flap B2 from its stand-by position not interfering with the movement of the pockets C1 . . . and is thereby successively fitted in the comb-shaped front end portions 1a, 2a of the first and second holding faces 1, 2, respectively. The tack heater 7f is kept in pressure contact with the superimposed portion of the inner and outer body flaps B2, B1 for a predetermined time, and almost simultaneously with the start of rotation of the turret C the front end 7a is moved back to its stand-by position.

As shown in FIG. 4, a secondary heater 8 for completely heat-bonding the tacked, superimposed portion B3 of the inner and outer body flaps B2, B2 is disposed around the pocket C1 which stops in the body flap bonding position P3 in such a manner that the secondary heater 8 can reciprocate in approaching and leaving directions with respect to the folding surface A5 of the box-like contents A in the pocket C1. The secondary heater 8 is connected to the same drive source as that of the pusher A', turret C and folding pieces 6, 7 and the operation thereof is controlled intermittently by means of a cam for example so that almost simultaneously with the stop of rotation of the turret C the secondary heater 8 is moved toward the superimposed portion B3 from a stand-by position thereof not interfering with the movement of the pockets C1 . . . and is kept in contact with the superimposed portion B3 for a predetermined time, then before the start of rotation of the turret C it is moved back to the stand-by position.

Further, as shown in FIG. 4, a discharge pusher 9 for drawing out the box-like contents A toward a side flap folding step from the pocket C1 which stops in the discharge position P4 is disposed around the said pocket C1 so as to be reciprocatable in the same direction as the loading direction of the box-like contents A. The discharge pusher 9 is connected to the same drive source as that of the pusher A', turret C, folding pieces 6,7 and secondary heater 8, and the operation thereof is controlled intermittently as follows by means of a cam for example. Substantially at the same time when the turret C stops rotation, the discharge pusher 9 is moved in the same direction as the loading direction of the box-like contents from a stand-by position there of not interfering with the pockets C1 . . . and is brought into abutment with the front-end face A3 of the box-like contents A present in the pocket C1 which stops in the discharge position P4, thereby pushing and moving the box-like contents A onto a conveyor belt (not shown) or the like in the side flap folding step. Thereafter, the discharge pusher 9 is moved back and is returned to its stand-by position by the time when the turret C starts rotation.

In this embodiment, the first and second holding faces 1 . . . , 2 . . . of each pocket C1 are each formed as bisplit faces in the right and left direction orthogonal to the loading direction of the box-like contents A, and an interlocking rod 9*a* of the discharge pusher 9 is inserted in a gap 9' formed therebetween, the front end of the rod 9*a* being connected to a drive source (not shown) to transfer power from the drive source to the discharge pusher 9.

The following description is now provided about the operation of the body flap folding apparatus in a packaging machine constructed as above.

First, as shown in FIG. 4, by the operation of the pusher A' the box-like contents A which have been inverted and raised are struck against the packaging material B, allowing the packaging material B to be wound in U shape around the body of the box-like contents, and is loaded toward the interior of the pocket C1 which stops in the loading position P1 on the turret C. As a result, as shown in FIGS. 1, 2 and 3, side flaps B4, B4 positioned on the front side in the loading direction of the packaging material B strike against the third holding faces 4, 4 and are folded along the right and left side faces A4, A4 of the box-like contents A.

In this state, since the terminal end of the passages 5*b* . . . of the pocket C1 which stops in the loading position P1 is in the position coincident with the suction control portion 5*c* as in FIG. 1, the suction holes 5*a* . . . of the suction and holding means 5 and the suction source come into communication with each other, whereby the outer body flap B1 is held by suction to the comb-shaped front end portion 1*a* of the first holding face 1 and is thereby maintained in a stand-up state.

Then, with rotation of the turret A, the pocket C1 with the box-like contents A and packaging material B loaded therein is conveyed from the loading position P1 to the folding position P2. Also during this period, the terminal end of the passages 5*b* . . . of the pocket C1 in question continues to be in alignment with the suction control section 5*c*, so that the outer body flap B1 is continued to be held by suction to the comb-shaped front end portion 1*a* of the first holding face 1 through the suction holes 5*a* . . . of the suction and holding means 5 and is thus maintained in its stand-up state without falling down in the direction opposite to the rotating direction.

After the above conveyance of the pocket is over, the folding piece 6 for the inner body flap B2 which has begun to swing comes into engagement with the comb-shaped front end portion 2*a* of the second holding surface 2 and the front end 6*a* thereof strikes the base end of the inner body flap B2 at the edge portion A6 positioned on the inner body flap B2 side of the folding surface A5 of the box-like contents A, whereby the base portion of the inner body flap B2 is bent along the edge portion A6. Thereafter, since the front end 6*a* undergoes a reaction force from the folding surface A5 of the box-like contents A, the resilient member 6*c* deviates from the arcuate track T1 while being deformed in the direction opposite to the biasing direction, and the inner body flap B2 is folded inside in a strained state along the folding surface A5 of the box-like contents A.

After this folding is over, the inner body flap folding piece 6 of the inner body flap begins its return movement. At this time there occurs friction between the folding piece 6 which is moving back and the surface of the folded inner body flap B2, so that even when the inner body flap B2 once folded tries to return in the direction opposite to the folding direction, its base end strikes against the comb-shaped front end portion 2*a* of the second holding surface 2 to prevent loosening of the flap.

Simultaneously with this return movement the folding piece 7 for the outer body flap B1 which has started to swing comes into engagement with the comb-shaped front end portion 1*a* of the first holding face 1 and its front end 7*a* strikes against the base end of the outer body flap B1 at the edge portion A7 positioned on the flap B1 side of the folding surface A5 of the box-like contents A, whereby the base end of the outer body flap B1 is bent along the edge portion A7 and at the same time the flap B1 is drawn apart from the suction holes 5*a* . . . of the suction and holding means 5. Thereafter, since the front end 7*a* undergoes a reaction force from the folding surface A5 of the box-like contents A, the resilient member 7*c* deviates from the arcuate track T2 while being deformed in the direction opposite to the biasing direction, whereby the outer body flap B1 is folded inside in a strained state along the folding surface A5 of the box-like contents A and is superimposed on the inner body flap B2 which has already been folded.

Subsequently, the tack heater 7*f* is kept in pressure contact with the superimposed portion B3 of the inner and outer body flaps B2, B1 for a predetermined time to effect tacking. Then, with rotation of the turret A the pocket C1 with the thus-tacked box-like contents A and packaging material B therein is conveyed from the folding position P2 to the body flap bonding position P3, and at the same time the succeeding pocket C1 with box-like contents A and packaging material B loaded therein is conveyed from the loading position P1 to the folding position P2.

After the conveyance of the pockets C1 is over, the secondary heater 8 which has approached the pocket C1 in the position P3 as described in FIG. 4 comes into pressure contact with the tacked, superimposed portion B3 of the inner and outer body flaps B2, B1 for a predetermined time, allowing the flaps to be heat-bonded together completely. Now the body flap bonding step is over. Then, the turret A rotates to convey the pocket C1 which has gone through the body flap bonding step to the discharge position P4 from the body flap bonding position P3. At the same time, the succeeding pocket C1 of tacked box-like contents A and packaging material B is conveyed from the folding position P2 to the body flap bonding position P3, and the pocket C1 which further follows the said pocket and with box-like contents A and packaging material B loaded therein is conveyed from the loading position P1 to the folding position P2.

After the conveyance of the pockets is over, the discharge pusher 9 which has approached the pocket C1 in the discharge position P4 strikes and pushes the front-end face A3 of the box-like contents A in the pocket C1 for delivery to the side flap folding step, followed by repetition of the operations described above.

Although in the above embodiment the box-like contents A in a cartoned state loaded from a cartoning machine are packaged with the packaging material B such as cellophane film or polypropylene film, this does not constitute any limitation. Box-like contents merely in an accumulated state of small-encased cigarettes may be packaged with a heat-bondable packaging material such as hot melt sandpaper or kraft paper. In the case of using kraft paper as the packaging material, an adhesive such as a hot melt adhesive is applied to a sealing position of the kraft paper when the paper has been loaded to a predetermined position by the operation of the carton loading mechanism B', e.g. suction belt, followed by bonding positively with the tack heater *7f* and the secondary heater 8.

Further, although in the above embodiment six pockets C1 . . . are provided on the turret C and are rotated 60° at a time in an intermittent manner, this constitutes no limitation. Any number of pockets C1 may be provided, which pockets are rotated intermittently by a predetermined angle in accordance with the number thereof adopted.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

I claim:

1. A body flap folding apparatus in a packaging machine wherein box-like contents are struck against a packaging member, allowing the packaging member to be wound in U shape around the body of the box-like contents, then plural said box-like contents with the packaging material thus wound thereon are loaded successively into a plurality of pockets provided radially on the outer periphery of a turret, and while the box-like contents and the packaging material are conveyed with rotation of the turret, body flaps of the packaging material are folded inside successively and heat-bonded together, said body flap folding apparatus comprising:

a front end portion of a first holding face, said front end portion being formed in opposition to an outer body flap of the packaging material projecting from the box-like contents in each of the plural pockets, said front end portion being formed in the shape of a comb having convexes and concaves which are continuous alternately in the right and left direction orthogonal to the projecting direction of the body flap;

a front end portion of a second holding face, said front end portion being formed in opposition to an inner body flap of the packaging material projecting from the box-like contents, said front end portion being formed in the shape of a comb having convexes and concaves which are continuous alternately in the right and left direction orthogonal to the projecting direction of the body flap;

a folding piece for the outer body flap, said folding piece being supported pivotably in the direction of engagement with the comb- shaped front end portion of the first holding face, said folding piece having a comb-shaped front end for engagement with the comb-shaped front end portion;

a folding piece for the inner body flap, said folding piece being supported pivotably in the direction of engagement with the comb- shaped front end portion of the second holding face, said folding piece having a comb-shaped front end for engagement with the comb-shaped front end portion;

a pivotable arm with the front end connected thereto so as to be reciprocatable in approaching and leaving directions with respect to a folding surface of the box-like contents;

a pivotable arm with the front end connected thereto so as to be reciprocatable in approaching and leaving directions with respect to the folding surface of the box-like contents;

a resilient member disposed between the front end and the pivotable arm to urge the front end continually toward the folding surface of the box-like contents;

a resilient member disposed between the front end and the pivotable arm to urge the front end continually toward the folding surface of the box-like contents;

means for controlling the amount of a resilient movement of the front end and thereby causing the front end to move along an arcuate track which gets into the box-like contents gradually through the folding surface of the box-like contents from an edge portion positioned on the to-be-folded body flap side of the folding surface; and means for controlling the amount of a resilient movement of the front end and thereby causing the front end to move along an arcuate track which gets into the box-like contents gradually through the folding surface of the box-like contents from an edge portion positioned on the to-be-folded body flap side of the folding surface.

2. A body flap folding apparatus in a packaging machine according to claim 1, wherein said means for causing the front end of the folding piece for the outer body flap to move along the arcuate track which gets into the box-like contents gradually through the folding surface from the edge portion of the folding surface controls a swing angle corresponding to the amount of a resilient movement of the front end and sets the swing angle so that a swing radius from a fulcrum of the pivotable arm is equal to the distance between the fulcrum and the edge portion of the folding surface; and said means for causing the front end of the folding piece for the inner body flap to move along the arcuate track which gets into the box-like contents gradually through the folding surface from the edge portion of the folding surface controls a swing angle corresponding to the amount of a resilient movement of the front end and sets the swing angle so that a swing radius from a fulcrum of the pivotable arm is equal to the distance between the fulcrum and the edge portion of the folding surface.

3. A body flap folding apparatus in a packaging machine according to claim 2, wherein said means for controlling the swing angle corresponding to the amount of a resilient movement of the front end of the folding piece for the outer body flap and setting the swing angle so that swing radius from the fulcrum of the pivotable arm is equal to the distance between the fulcrum and the edge portion of the folding surface is attained by bringing a stopper connected to the pivotable arm into abutment with the front end; and said means for controlling the swing angle corresponding to the amount of a resilient movement of the front end of the folding piece for the inner body flap and setting the swing angle so that the swing radius from the fulcrum of the pivotable arm is equal to the distance between the fulcrum and the edge portion of the folding surface is attained by bringing a stopper connected to the pivotable arm into abutment with the front end.

4. A body flap folding apparatus in a packaging machine according to claim 1, further comprising a tack heater adapted to come into pressure contact with a superimposed portion of the inner and outer body flaps after folding, said tack heater being connected to the folding piece for the outer body flap in a rear position in the swing direction.

5. A body flap folding apparatus in a packaging machine according to claim 2, further comprising a tack heater adapted to come into pressure contact with a superimposed portion of the inner and outer body flaps after folding, said tack heater being connected to the folding piece for the outer body flap in a rear position in the swing direction.

6. A body flap folding apparatus in a packaging machine according to claim 4, wherein said tack heater is formed in the shape of a comb for engagement with the comb-shaped front end portions of the first holding face and the second holding face.

7. A body flap folding apparatus in a packaging machine according to claim 5, wherein said tack heater is formed in the shape of a comb for engagement with the comb-shaped front end portions of the first holding face and the second holding face.

8. A body flap folding apparatus in a packaging machine according to claim 6, wherein said turret operates intermittently and thereby causes the plural pockets to rotate intermittently by a predetermined angle at a time, and the folding piece for the outer body flap and the folding piece for the inner body flap are disposed around the pocket which has stopped in a folding position on a downstream side in the rotating direction of the turret with respect to a loading position in which the packaging material and the box-like contents are loaded into the pocket.

9. A body flap folding apparatus in a packaging machine according to claim 7, wherein said turret operates intermittently and thereby causes the plural pockets to rotate intermittently by a predetermined angle at a time, and the folding piece for the outer body flap and the folding piece for the inner body flap are disposed around the pocket which has stopped in a folding position on a downstream side in the rotating direction of the turret with respect to a loading position in which the packaging material and the box-like contents are loaded into the pocket.

10. A body flap folding apparatus in a packaging machine according to claim 8, wherein the folding piece for the inner body flap is controlled so as to start moving pivotally in the folding direction of the inner body flap from a stand-by position thereof not interfering with the movement of the pockets in interlock with the rotation of the turret, bring its front end into abutment with the inner body flap in interlock with the stop of rotation of the turret, and cause the front end to return in the reverse direction after reaching a predetermined position on the folding surface of the box-like contents.

11. A body flap folding apparatus in a packaging machine according to claim 9, wherein the folding piece for the inner body flap is controlled so as to start moving pivotally in the folding direction of the inner body flap from a stand-by position thereof not interfering with the movement of the pockets in interlock with the rotation of the turret, bring its front end into abutment with the inner body flap in interlock with the stop of rotation of the turret, and cause the front end to return in the reverse direction after reaching a predetermined position on the folding surface of the box-like contents.

12. A body flap folding apparatus in a packaging machine according to claim 10, wherein the folding piece for the outer body flap is controlled so as to start moving pivotally toward the outer body flap from the stand-by position not interfering with the movement of the pockets in interlock with the return movement of the folding piece for the inner body flap, thereby bring the front end into engagement with the comb- shaped front end portion of the first holding face, and cause the front end to return in the reverse direction nearly simultaneously with the start of rotation of the turret.

13. A body flap folding apparatus in a packaging machine according to claim 11, wherein the folding piece for the outer body flap is controlled so as to start moving pivotally toward the outer body flap from the stand-by position not interfering with the movement of the pockets in interlock with the return movement of the folding piece for the inner body flap, thereby bring the front end into engagement with the comb- shaped front end portion of the first holding face, and cause the front end to return in the reverse direction nearly simultaneously with the start of rotation of the turret.

14. A body flap folding apparatus in a packaging machine wherein box-like contents are struck against a packaging material, allowing the packaging material to be wound in U shape around the body of the box-like contents, then plural said box-like contents with the packaging material thus wound thereon are loaded successively into a plurality of pockets provided radially on the outer periphery of a turret, and while the box-like contents and the packaging material are conveyed with rotation of the turret, body flaps of the packaging material are folded inside successively and heat-bonded together, said body flap folding apparatus comprising:

a front end portion of a first holding face of each of said plural pockets, said first holding face being positioned on the rotating direction side of the turret, and said front end portion being opposed to an outer body flap of the packaging material projecting from the box-like contents; and a suction and holding means for holding the outer body flap by suction in a section from a loading position of the box-like contents and the packaging material to a folding position of the outer body flap, said suction and holding means being provided in the front end portion.

15. A body flap folding apparatus in a packaging machine according to claim 14, wherein said suction and holding means comprises:

suction holes formed in the first holding face opposingly to the outer body flap;

a suction source communicating with the suction holes;

a passage for communication between the suction holes and the suction source; and a suction control portion for providing communication of said passage only in the section from the pocket stopped in the loading position to the pocket stopped in the folding position, said suction control portion being provided halfway of said passage.

16. A body flap folding apparatus in a packaging machine according to claim 15, wherein said passage is formed in a plural number circumferentially along the outer peripheral surface of a rotating shaft of the turret so that terminal ends of the plural passages face toward a support holder; and said suction control portion is formed in the inner peripheral surface of the support holder opposed to the terminal ends of the plural passages so as to become aligned with only the terminal end of the passage in the pocket positioned in the section from the loading position to the folding position.

17. A body flap folding apparatus in a packaging machine according to claim 14, wherein the front end portion of the first holding face with the suction and holding means provided therein is formed in the shape of a comb having convexes and concaves which are continuous alternately in the right and left direction orthogonal to the projecting direction of the outer body flap, and a folding piece for the outer body flap is formed in the shape of a comb for engagement with said comb- shaped front end portion of the first holding face and is supported pivotably in the direction of engagement with the comb-shaped front end portion of the first holding face.

18. A body flap folding apparatus in a packaging machine according to claim 15, wherein the front end portion of the first holding face with the suction and holding means provided therein is formed in the shape of a comb having convexes and concaves which are continuous alternately in the right and left direction orthogonal to the projecting direction of the outer body flap, and a folding piece for the outer body flap is formed in the shape of a comb for engagement with said comb- shaped front end portion of the first holding face and is supported pivotably in the direction of engagement with the comb-shaped front end portion of the first holding face.

19. A body flap folding apparatus in a packaging machine according to claim 16, wherein the front end portion of the first holding face with the suction and holding means provided therein is formed in the shape of a comb having convexes and concaves which are continuous alternately in the right and left direction orthogonal to the projecting direction of the outer body flap, and a folding piece for the outer body flap is formed in the shape of a comb for engagement with said comb- shaped front end portion of the first holding face and is supported pivotably in the direction of engagement with the comb-shaped front end portion of the first holding face.

* * * * *